US007217442B2

(12) United States Patent
Wilt et al.

(10) Patent No.: US 7,217,442 B2
(45) Date of Patent: May 15, 2007

(54) METHOD AND APPARATUS FOR MIXING AND APPLYING A MULTI-COMPONENT COATING COMPOSITION

(75) Inventors: Truman F. Wilt, Clinton, PA (US); David N. Walters, Slippery Rock, PA (US); James A. Claar, Apollo, PA (US); John R. Rassau, Allison Park, PA (US); Melanie S. Campbell, Oakmont, PA (US)

(73) Assignee: PPG Industries, Ohio, Inc., Cleveland, OH (US)

( * ) Notice: Subject to any disclaimer, the term of this patent is extended or adjusted under 35 U.S.C. 154(b) by 0 days.

(21) Appl. No.: 10/870,301

(22) Filed: Jun. 17, 2004

(65) Prior Publication Data

US 2004/0234698 A1 Nov. 25, 2004

Related U.S. Application Data

(63) Continuation-in-part of application No. 10/324,725, filed on Dec. 19, 2002.

(60) Provisional application No. 60/343,076, filed on Dec. 20, 2001.

(51) Int. Cl.
*B05D 1/34* (2006.01)

(52) U.S. Cl. ..... 427/426; 427/421.1; 427/385.5; 427/386

(58) Field of Classification Search ..... 427/385.5, 427/386, 421, 426
See application file for complete search history.

(56) References Cited

U.S. PATENT DOCUMENTS

| | | | | |
|---|---|---|---|---|
| 2,511,627 A | | 6/1950 | Einbecker | 117/104 |
| 3,179,341 A | | 4/1965 | Plos et al. | 239/414 |
| 3,784,110 A | | 1/1974 | Brooks | 239/304 |
| 4,767,025 A | | 8/1988 | Gebauer et al. | 222/135 |
| 4,881,821 A | | 11/1989 | Stutz | 366/162 |
| 5,219,097 A | | 6/1993 | Huber et al. | 222/145 |
| 5,405,083 A | | 4/1995 | Moses | 239/9 |
| 5,713,519 A | * | 2/1998 | Sandison et al. | 239/8 |
| 5,738,934 A | * | 4/1998 | Jones | 428/220 |
| 5,869,566 A | | 2/1999 | Thomas | 524/590 |

(Continued)

FOREIGN PATENT DOCUMENTS

EP 0 750 946 A2 1/1997

(Continued)

OTHER PUBLICATIONS

"Poiseuille's Law" in http://hyperphysics.phy-astr.gsu.edu/hbase.

*Primary Examiner*—Alain L. Bashore
(74) *Attorney, Agent, or Firm*—Donald R. Palladino; Carol A. Marmo

(57) ABSTRACT

A method of applying a multi-component coating of a desired composition over a substrate includes providing a coating device in flow communication with a first coating component having a first rheological profile and at least one second coating component having a second rheological profile. The method further includes defining a desired ratio of the first and at least one second coating components to provide a coating of a desired composition, and selecting the rheological profiles of the first and at least one second coating components such that the coating components are supplied at a desired ratio.

4 Claims, 3 Drawing Sheets

U.S. PATENT DOCUMENTS

| | | | | |
|---|---|---|---|---|
| 5,922,299 | A * | 7/1999 | Bruinsma et al. | 423/335 |
| 5,954,273 | A | 9/1999 | Ruta et al. | 239/419.3 |
| 6,005,045 | A | 12/1999 | Klanica | 527/507 |
| 6,054,535 | A | 4/2000 | Wilt et al. | 525/100 |
| 6,130,286 | A | 10/2000 | Thomas et al. | 524/507 |
| 6,131,823 | A | 10/2000 | Langeman | 239/291 |
| 6,136,928 | A | 10/2000 | Wilt et al. | 525/474 |
| 6,169,150 | B1 | 1/2001 | Swarup et al. | 525/533 |
| 6,228,971 | B1 | 5/2001 | Martz et al. | 528/127 |
| 6,297,311 | B1 | 10/2001 | Casper et al. | 524/507 |

FOREIGN PATENT DOCUMENTS

| | | |
|---|---|---|
| GB | 881982 | 11/1952 |

* cited by examiner

METHOD AND APPARATUS FOR MIXING AND APPLYING A MULTI-COMPONENT COATING COMPOSITION

CROSS REFERENCE TO RELATED APPLICATION

This application is a continuation-in-part of U.S. patent application Ser. No. 10/324,725, filed Dec. 19, 2002 entitled, "Method and Apparatus for Mixing and Applying A Multi-Component Coating Composition", which claims the benefits of U.S. Provisional Application Ser. No. 60/343,076 filed Dec. 20, 2001, both of which are herein incorporated by reference in their entirety.

BACKGROUND OF THE INVENTION

1. Field of the Invention

This application relates generally to a method and apparatus for applying a multi-component coating of a desired composition over a substrate and, more particularly, to a method and apparatus for applying a multi-component refinish coating over an automotive substrate.

2. Technical Considerations

Automotive refinish coatings are used to cover damaged areas of a vehicle in order to restore the original appearance of the vehicle. Conventional refinish coatings are typically supplied to automotive repair shops in the form of multi-package systems. An example of one such system is a two-package system, with one package containing a polymeric material and the other package containing a catalyst or curing agent. When a refinish coating is to be applied onto an automotive substrate, the components in the separate packages are mixed together, typically at a particular ratio specified by the coating manufacturer, and the mixed coating composition is placed into a container. The container is connected to a coating device, such as a pneumatic spray gun, and the mixed coating composition is spray applied onto the automotive substrate.

While generally acceptable for most automotive refinish operations, this conventional refinish coating method does have some drawbacks. For instance, after mixing the separate components together, the pot-life of the resultant coating composition is typically limited to only about 30 minutes. By "pot-life" is meant the time within which the coating composition must be used before the coating composition becomes too viscous to be applied due to cross-linking or curing. Also, since most refinish coating jobs need only cover a relatively small area of a vehicle, the separate packages typically do not contain a large amount of the respective coating components. Therefore, for larger jobs, several different batches of the coating composition must be consecutively prepared and applied. This batch mixing increases the time required to coat a large substrate and requires the coating process to be intermittently stopped and started while batches of the coating composition are mixed. As will be appreciated by one skilled in the refinish coating art, it would be advantageous to increase the curing speed of the coating composition to decrease the curing time of the applied coating composition so that the applied coating could be more quickly sanded or further coatings applied. However, increasing the curing speed would also disadvantageously decrease the pot-life of the mixed coating composition.

In an attempt to alleviate some of these problems, spray devices have been developed in which specific amounts of the separate coating components are mechanically metered to the spray device to provide a desired coating composition. Examples of known coating dispensers are disclosed in U.S. Pat. Nos. 5,405,083; 4,881,821; 4,767,025; and 6,131,823. While generally acceptable, the mechanical pumping and metering equipment required to accurately meter specific amounts of the coating components to the spray device add to the overall cost of the system. Moreover, the metering equipment must be regularly checked and maintained to ensure that it is in proper working order to accurately supply the required amounts of the coating components to the spray device.

As will be appreciated by one skilled in the automotive refinish coating art, it would be advantageous to provide a method and/or apparatus for applying a multi-component coating onto a substrate which reduces or eliminates at least some of the drawbacks of known coating application systems.

SUMMARY OF THE INVENTION

A method is provided for applying a multi-component coating of a desired composition over a substrate. The method includes providing a coating device in flow communication with a first coating component having a first rheological profile and at least one other, e.g., second, coating component having a second Theological profile which can be the same or different than the Theological profile of the first coating component. The rheological profiles of the coating components, e.g., two or more coating components, can be selected such that the coating components are supplied to the apparatus and/or are mixed to provide a coating having a desired ratio of the coating components, e.g., a coating having a desired amount of one or more materials from the first coating component and a desired amount of one or more materials from the at least one other coating component. In one embodiment, the ratios of the coating components supplied to the coating device is substantially proportional to the relative viscosities of the coating components. In one particular embodiment, the coating components can be supplied under pressure, e.g., under substantially the same pressure, to the coating device.

A coating system is provided for applying a multi-component coating composition over a substrate. In one embodiment, the coating system includes at least one coating device having a first conduit and at least one other, e.g., second, conduit. A first coating component having a first rheological profile can be placed in flow communication with the first conduit and one or more other (e.g., second) coating components having the same or different rheological profile as the first coating component can be placed in flow communication with the at least one other conduit. The coating system can include means for directing the coating components into the coating device such that the amount of the coating components in a resultant coating composition is substantially proportional to the rheological profiles of the coating components. The first coating component can include one or more materials, e.g., polymeric materials, having reactive groups capable of reacting with the functional groups of one or more materials, e.g., crosslinking materials, in the at least one other coating component.

DESCRIPTION OF THE INVENTION

Figure 1:
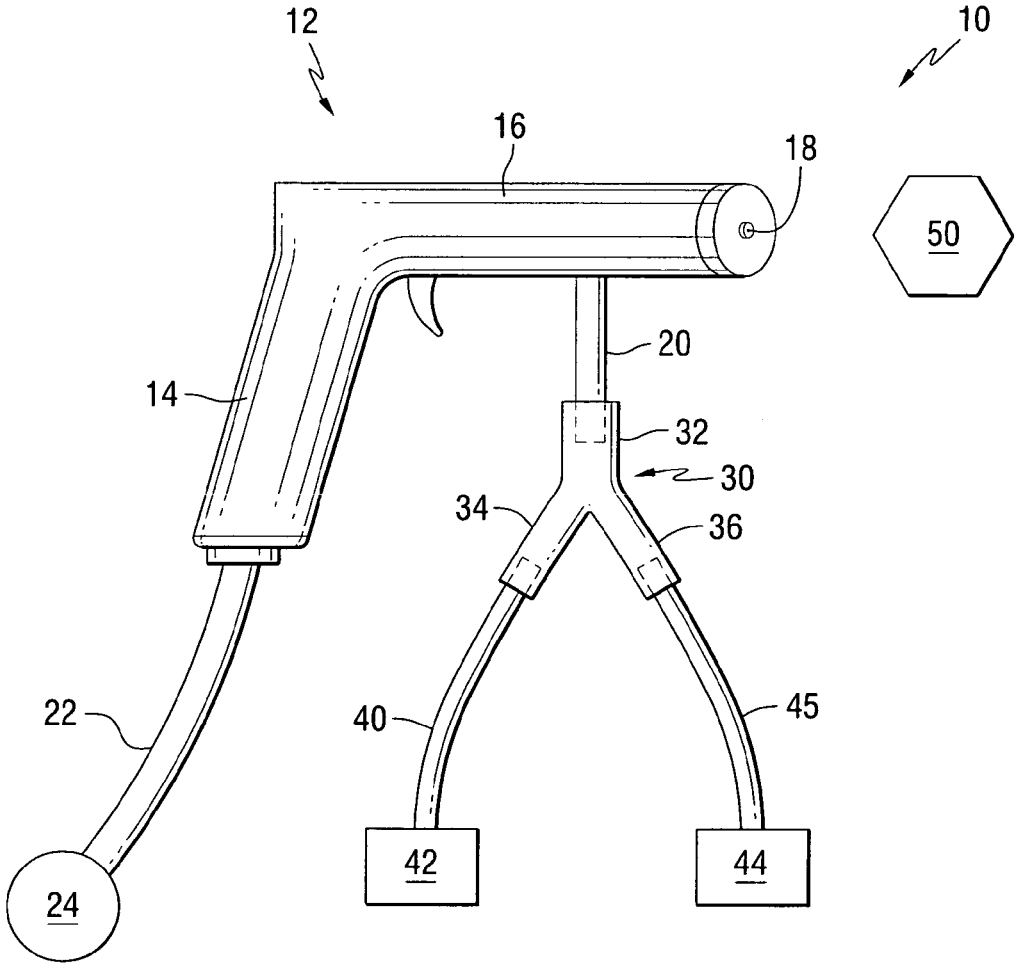
FIG. 1 is a schematic, side view (not to scale) of a coating system incorporating features of the invention.

As used herein, spatial or directional terms, such as "left", "right", "inner", "outer", "above", "below", "top", "bottom", and the like, relate to the invention as it is shown in the drawing figures. However, it is to be understood that the invention may assume various alternative orientations and, accordingly, such terms are not to be considered as limiting. Further, as used herein, all numbers expressing dimensions, physical characteristics, processing parameters, quantities of ingredients, reaction conditions, and the like, used in the specification and claims are to be understood as being modified in all instances by the term "about". Accordingly, unless indicated to the contrary, the numerical values set forth in the following specification and claims are approximations that may vary depending upon the desired properties sought to be obtained by the present invention. At the very least, and not as an attempt to limit the application of the doctrine of equivalents to the scope of the claims, each numerical value should at least be construed in light of the number of reported significant digits and by applying ordinary rounding techniques. Moreover, all ranges disclosed herein are to be understood to include the beginning and ending range values and to encompass any and all subranges subsumed therein. For example, a stated range of "1 to 10" should be considered to include any and all subranges between (and inclusive of) the minimum value of 1 and the maximum value of 10; that is, all subranges beginning with a minimum value of 1 or more and ending with a maximum value of 10 or less, e.g., 5.5 to 10. Further, as used herein, terms such as "deposited over", "applied over", or "provided over" mean deposited or provided on but not necessarily in contact with the surface. For example, a coating composition "deposited over" a substrate does not preclude the presence of one or more other coating films of the same or different composition located between the deposited coating and the substrate. Molecular weight quantities used herein, whether Mn or Mw, are those determinable from gel permeation chromatography using polystyrene as a standard. Also, as used herein, the term "polymer" includes oligomers, homopolymers, and copolymers.

Exemplary apparatus and methods for applying a multi-component coating onto a substrate in accordance with the present invention will now be described with particular reference to the application of a multi-component, e.g., two component, refinish coating onto an automotive substrate using a pneumatic spray device. However, it is to be understood that the invention is not limited to use with refinish coatings or automotive substrates but can be practiced with any multi-component coating type on any desired substrate. Additionally, the invention is not limited to use with pneumatic spray devices. Moreover, the invention is not limited to two component systems but can be practiced with any number of components, e.g., two or more components.

A first exemplary coating system 10 incorporating features of the invention is schematically shown in FIG. 1. The system 10 includes a coating device 12. The coating device 12 can be of any conventional type, such as pneumatic, electrostatic, gravity fed, pressure fed, etc. In the exemplary embodiment shown in FIG. 1, the coating device 12 is a pneumatic, siphon-feed coating gun having a handle 14, a body 16, a nozzle 18, and a siphon tube 20. The exemplary coating device 12 also includes a carrier fluid conduit 22 in flow communication with a source 24 of carrier fluid, such as a liquid or gaseous carrier fluid. In one embodiment, the carrier fluid is compressed air supplied at a pressure of about 10 pounds per square inch-gauge (psig) to 100 psig (0.7 kg/sq. cm to 7 kg/sq. cm), such as 20 psig to 80 psig (1.4 kg/sq. cm to 5.6 kg/sq. cm), e.g., 40 psig to 60 psig (2.8 kg/sq. cm to 4.2 kg/sq. cm). As will be appreciated by one skilled in the art, the carrier fluid conduit 22 directs carrier fluid through a passage in the device 12 to the nozzle 18. The inner end of the siphon tube 20 is in flow communication with the carrier fluid passage in the device 12 in conventional manner. The structure and operation of a conventional pneumatic, siphon-feed spray gun will be well understood by one of ordinary skill in the automotive refinish art and, hence, will not be discussed in detail. One suitable pneumatic, siphon-feed coating device that can be used in the practice of the invention is a Binks Model 62 spray gun manufactured by ITW Incorporated.

In previous practice, the siphon tube 20 would be connected to a single container containing a mixed coating composition as described above. However, in the practice of the invention, the siphon tube 20 is connected to, or forms, a multi-inlet connector 30. In the exemplary embodiment shown in FIG. 1, the connector 30 is depicted as a hollow, "Y-shaped" connector having a base 32, a first inlet or conduit 34 and a second inlet or conduit 36. The base 32 is connected to the siphon tube 20, e.g., by a friction fit or by any conventional attachment devices. The first conduit 34 is connected to a first conduit or collection tube 40 in flow communication with a source 42 of a first coating component, e.g., one component of a multi-component refinish coating, and the second conduit 36 is connected to a second conduit or collection tube 45 in flow communication with a source 44 of a second coating component, e.g., another component of the multi-component refinish coating. While in this exemplary embodiment only two conduits 34, 36 are present on the connector 30, it will be appreciated by one of ordinary skill in the art that the invention is not limited to use with two-component systems. For example, for three-component systems, the connector 30 could have three inlets (conduits), each in flow communication with one of the coating components. Additionally, the collection tubes 40, 45 do not have to be separate pieces but could simply be extensions of the first and second conduits 34, 36.

For purposes of explanation with respect to a two-component system, the first component can be a liquid, e.g., a solution, and can include one or more materials having at least two reactive groups capable of reacting with the functional groups of the second component. For example, the first component can include one or more materials having reactive groups, such as hydroxyl, epoxy, acid, amine, aziridine, or acetoacetate groups, just to name a few. In one embodiment, the first component can include any conventional resinous or polymeric coating material having two or more reactive groups. For example, the first component can include polyol, polyester, polyurethane, polysiloxane, or polyacrylate-containing materials, just to name a few. In one embodiment, the first component can include a medium molecular weight polymeric polyol, e.g., a polymeric polyol having an Mn in the range of 200 to 100,000, such as 1,000 to 75,000, such as 3,000 to 50,000, such as 5,000 to 20,000.

The second component can be a liquid, e.g., a solution, and can include one or more materials having functional groups configured to react with the reactive groups of the one or more materials in the first component to set or cure (e.g., crosslink with) the materials in the first component to form the resultant coating. For example, but not to be considered as limiting, the second component can include a polyisocyanate curing agent, aminoplast resins, or phenoplast resins, just to name a few. Examples of suitable coating components and curing agents for the practice of the invention are disclosed in, but are not limited to, U.S. Pat. Nos. 6,297,311; 6,136,928; 5,869,566; 6,054,535; 6,228,971; 6,130,286; 6,169,150; and 6,005,045, each of which is herein incorporated by reference in its entirety.

Unlike previous refinish coating systems, the system 10 of the present invention does not require the presence of supply pumps or metering pumps between the coating component sources 42 and 44 and the coating device 12 to meter selected amounts of the two components to the coating device 12. Rather, in the practice of the invention and as described below, the composition of the resultant coating composition applied onto a substrate 50 from the coating device 12 can be selected, changed, or adjusted by selecting, changing, or adjusting the rheological profiles of the coating components, e.g., first and/or second coating components. As used herein, the term "rheological profile" refers to the viscosity of a material as measured under different sheer rates and temperature ranges.

In the practice of the invention, the rheological profiles of the coating components for the system shown in FIG. 1 can be selected or adjusted such that under a particular set of application conditions, e.g., temperature, carrier fluid pressure and/or flow rate, or shear rate, the coating components are pulled into the coating device 12 due to the flow of the carrier fluid through the device and the components are combined at a desired ratio, e.g., volume ratio, that is substantially proportional to the rheological profiles, e.g., viscosities, of the components to form a coating material of a desired composition. As will be appreciated by one of ordinary skill in the art, the rheological profile of a material can be adjusted in any conventional manner, such as by changing the molecular weight of the resinous or polymeric material per unit volume, the type of solvent used, the total amount of solids present in the composition, the addition or removal of pigmentation, and other ways common in the coating art. Alternatively, or in addition thereto, the relative amounts of the coating components drawn into the device 12 can be adjusted by varying the diameters of the collection tubes 40 and 45.

With reference to the two-component system described above and shown in FIG. 1, to apply a coating composition having two parts (e.g., two parts by volume) of the first coating component and one part (e.g., one part by volume) of the second coating component, the rheological profiles of the two coating components can be adjusted such that under the selected coating conditions (e.g., the applied sheer rate and temperature of the two coating components), the second coating component has a viscosity two times (or about two times) the viscosity of the first coating component. As the carrier fluid (e.g., compressed air) moves through the coating device 12, the suction created by the air flow sucks the first and second coating components through the collection tubes 40, 45, the connector 30, and into the coating device 12 where the two components can be mixed in conventional manner, such as by flow through a mechanical mixing device or into a mixing chamber, before being discharged through the nozzle 18.

As will be appreciated by those skilled in the art, the rheological profiles, e.g., viscosities, of the coating components needed to achieve a desired coating composition can be determined by connecting the coating components to the device 12 and measuring the amounts of the coating components in the resultant composition discharged from the nozzle 18. If the amount of one or more components in the resultant coating needs adjustment, the Theological profile of such components can be adjusted to achieve the desired coating composition. Thus, to achieve a 2:1 ratio, e.g., volume ratio, of the first and second coating components in the coating composition, the ratio of the viscosities of the first and second coating components may not necessarily be exactly 1:2. As will be appreciated by one skilled in the art, the amount of the one or more materials, e.g., polymeric materials, per unit volume in the first coating component and the amount of the one or more materials, e.g., crosslinking materials, per unit volume in the second coating component can be selected or adjusted such that at selected viscosities of the first and second coating components a selected amount of the polymeric materials and a selected amount of the crosslinking materials are delivered to the coating device 12. For example, the amounts of the materials in the coating components can be selected such that a 1:1 volume mix ratio of the first and second coating components (e.g., a 1:1 viscosity ratio) provides a 1.1:1 (or greater) equivalent ratio of the functional groups (e.g., NCO) of the second component to the reactive groups (e.g., OH) of the first component. In one example, the amount of the reactive groups and/or functional groups per unit volume of the first and/or second coating components can be adjusted, for example, by mixing or preparing the first and/or second coating components with similar solvents but containing non-reactive resins or materials to adjust (e.g., decrease) the number of reactive or functional groups per unit volume without significantly changing the rheological profiles, e.g., viscosities, of the coating components.

As mentioned earlier, the first component and the second component may comprise one or more materials having functional groups. In certain embodiments of the present invention, the Theological profile of at least one of the first coating component and the at least one other coating component, i.e., the second coating component, is selected by including in such components two or more materials comprising different functional groups. In such embodiments, at least one of the first coating component and the at least one other coating component comprises a first material comprising functional groups of a first chemical species and a second material comprising functional groups of a second chemical species, wherein the first and second chemical species are (i) different one from the other and (ii) compatible with each other. As used herein, the term "compatible with each other" means that the chemical species are storage-stable when combined each other, such that the species do not react so that they component becomes too viscous to be applied.

For example, as mentioned earlier, in certain embodiments the first component can include one or more materials having functional groups selected from the hydroxyl, epoxy, amine, or aziridine chemical species. In such cases where the first component comprises a first material comprising hydroxyl functional groups, the rheological profile of the first component can be selected by including in that component at least one other material having functional groups of the epoxy, amine, acetoacetate, cabodiimide, aziridine, acrylate, or ketimine, aldimine or aspartic ester chemical species, including mixtures thereof. In cases where the first component comprises a first material comprising epoxy functional groups, the rheological profile of the first component can be selected by including in that component at least one other material having functional groups of the acetoacetate or alkoxysilane chemical species, including mixtures thereof. In cases where the first component comprises a first material comprising amine functional groups, the rheological profile of the first component can be selected by including in that component at least one other material having functional groups of the silane chemical species. In cases where the first component comprises a first material comprising aziridine functional groups, the rheological profile of the first component can be selected by including in that component at least one material comprising functional groups of the alkoxysilane chemical species.

Moreover, as mentioned earlier, in certain embodiments the second component can include one or more materials having functional groups configured to react with the reactive groups of the one or more materials in the first component to set or cure the materials in the first component. In such embodiments, the rheological profile of the second coating component can be selected by including in such a component two or more materials comprising different functional groups, as indicated above.

For example, in such cases where the second component comprises a first material comprising isocyanate functional groups, the Theological profile of the second component can be selected by including in that component at least one other material having functional groups of the epoxy, alkoxy silane, or polyanhydride chemical species, including mixtures thereof. In such cases where the second component comprises a first material comprising acrylate functional groups, the rheological profile of the second component can be selected by including in that component at least one other material having functional groups of the alkoxy silane chemical species. In such cases where the second component comprises a first material comprising acetoacetate functional groups, the rheological profile of the second component can be selected by including in that component at least one other material having functional groups of the acrylate chemical species. In such cases where the second component comprises a first material comprising anhydride functional groups, the rheological profile of the second component can be selected by including in that component at least one other material having functional groups of the epoxy or alkoxy silane chemical species, including mixtures thereof.

In certain embodiments of the present invention, the rheological profile of at least one of the first coating component and the at least one other coating component is selected by including in such components three materials comprising different functional groups. In such embodiments, at least one of the first coating component and the at least one other coating component comprises a first material comprising functional groups of a first chemical species, a second material comprising functional groups of a second chemical species, and a third material comprising functional groups of a third chemical species, wherein the first, second and third chemical species are (i) different one from the other and (ii) compatible with each other.

For example, in certain embodiments, the first component may comprise materials comprising hydroxyl functional groups, materials comprising amine functional groups and materials comprising aspartic ester functional groups. In other embodiments, the first component may comprise materials comprising hydroxyl functional groups, materials comprising amine functional groups and materials comprising alkoxy silane functional groups. Moreover, in certain embodiments, the second component may comprise materials comprising isocyanate functional groups, materials comprising epoxy functional groups, and materials comprising silane functional groups. In other embodiments, the second component may comprise materials comprising isocyanate functional groups, materials comprising anhydride functional groups, and materials comprising acrylate functional groups.

Figure 2:
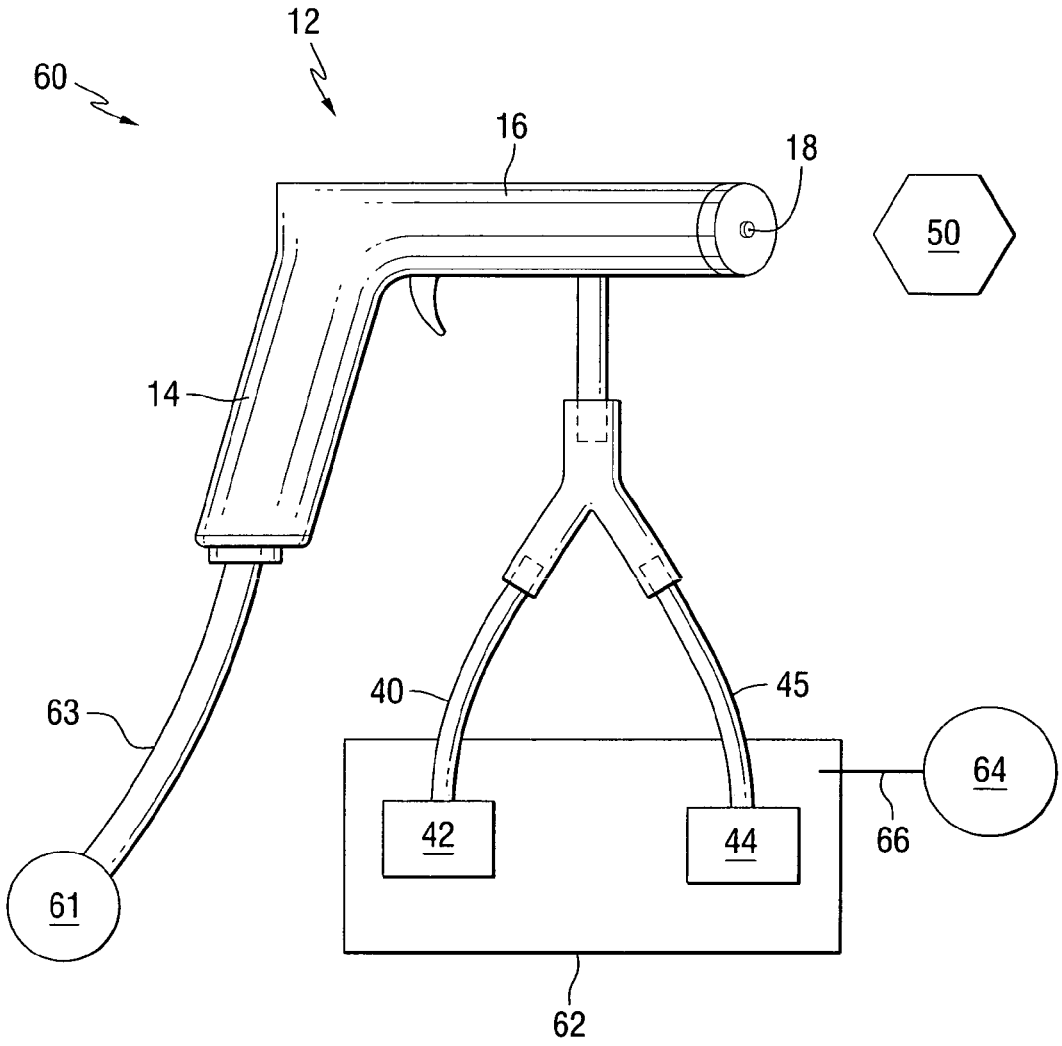
FIG. 2 is a schematic, side view (not to scale) of another coating system incorporating features of the invention.

Another coating system 60 of the invention is shown in FIG. 2. The coating system 60 is a pressurized coating system rather than a siphon coating system as shown in FIG. 1. In this embodiment, the coating device 12 is in flow communication with a source of atomizing air 61 via an atomizing air conduit 63. The first and second coating components 42, 44 can be contained within one or more pressure vessels 62. For example, the coating components can both be present in the same pressure vessel 62 (as shown in FIG. 2) or can be located in separate pressure vessels 62, each under the same or substantially the same pressure. In the illustrated embodiment, the pressure vessel 62 is in flow communication with a source 64 of pressurized fluid, such as pressurized air, via a conduit 66. The first and second collection tubes 40, 45 can be connected to the coating device 12 in any conventional manner. The coating device 12 can include any conventional valve assembly or control valve configuration, such as but not limited to needle valves, ball valves, and the like, to permit the coating components to be introduced into and/or discharged from the coating device 12. The coating device 12 can also include any conventional type of mixer, such as a static mixer or in-line mixer, to mix the two or more coating components before they are discharged from the coating device 12.

Operation of the coating system 60 will now be described with particular reference to applying a two-component system. Atomizing air from the atomizing air source 61 can be directed through the body 16 of the coating device 12 to atomize the coating composition discharged from the nozzle 18. Such an atomization system will be well understood by one of ordinary skill in the art and will not be discussed in detail herein. Essentially, the atomization air atomizes the coating composition discharged from the nozzle 18 to help provide a uniform coating mixture onto the substrate 50. In this embodiment, the first and second coating components 42, 44 can be placed inside the pressure vessel 62 and then the vessel 62 closed. Pressurized fluid from the fluid source 64 can then be directed into the pressure vessel 62 to pressurize the interior of the vessel 62. In one embodiment, the interior of the vessel 62 can be raised to a pressure between about 2–20 psig (0.14 to 1.4 kg/sq. cm), such as 3–15 psig (0.21 to 1 kg/sq. cm), such as 4–10 psig (0.3 to 0.7 kg/sq. cm), such as 6–8 psig (0.4 to 0.6 kg/sq. cm). Since the interior of the vessel 62 is under pressure, this pressure forces the first and second coating components 42, 44 to flow through the respective collection tubes 40, 45 and into the coating device 12 where the components can be mixed and then discharged. The flow of the coating components into the coating device (and, hence, the composition of the resultant coating) is proportional, or substantially proportional, to the rheological profiles of the coating components.

These exemplary coating systems 10 and 60 of the invention provide easy-to-use, low-cost methods and devices for applying a multi-component coating composition, such as a multi-component refinish coating, onto a substrate. Since no complex pumps or metering devices are required, the initial cost of the device is lowered and the maintenance requirements are lower than that for systems having such pumps and metering devices. Additionally, since the two components are not mixed prior to application, the curing agent can be configured to cure the polymeric material in a faster time.

In another aspect of the invention, for coating system 10, the connector and associated collection tubes can be provided as a kit to modify an existing coating device to allow practice of the invention. Moreover, for any coating system (e.g., 10 or 60) of the invention, a plurality of coating components of the same or different rheological profiles can be provided along with information (e.g., charts, tables, formulas, etc.) on their rheological profiles to allow a purchaser to select coating components of predetermined Theological profiles to achieve a desired final coating composition.

The following Examples are presented to demonstrate the general principles of the invention. However, the invention should not be considered as limited to the specific Examples presented.

EXAMPLE 1

A Binks Model 62 siphon-feed spray gun (manufactured by ITW Incorporated) was modified by attaching a piece of Tygon tube 2 inches (5 cm) long having an inner diameter of ⅜ inch (0.95 cm) to the spray gun siphon tube. A plastic Y connector 2 inches (5 cm) long and having an inner diameter of ¼ inch (0.6 cm) was connected to the other end of the Tygon tube. A piece of Tygon tube having a length of 3 inches (7.6 cm) and an inner diameter of ⅜ inch (0.95 cm) was attached to each branch of the Y connector to provide two collection tubes extending from the connector.

Cold rolled steel panels having an electrodeposited ED5000 primer coating (the primer coated steel panels being commercially available from ACT Laboratories Inc., of Hillsdale, Mich., under the commercial designation APR39375) were lightly sanded by hand with 400 grit sandpaper. A urethane sealer (K36 urethane sealer commercially available from PPG Industries Inc. of Pittsburgh, Pa.) was applied in accordance with the manufacturer's instructions and allowed to cure overnight at ambient temperature. An acrylic basecoat (D9700 Global Basecoat commercially available from PPG Industries Inc.) was spray applied to the sealed panels in accordance with the manufacturer's instructions and allowed to dry at ambient conditions for 30 minutes. The basecoated panels were then topcoated with clearcoats in the following manner.

Three aqueous solutions were prepared. The first (Solution A) was distilled water. The second (Solution B) was an aqueous mixture (solution) of distilled water and red food coloring (commercially available from McCormick and Co., Hunt Valley, Md.). The third solution (Solution C) was a 1:1 mixture by weight of Solution A and Solution B. Separate containers holding quantities of Solution A and Solution B were connected to the separate collection tubes and compressed air at a pressure of 45 pounds per square inch (3 kg/sq. cm) was introduced through the carrier fluid conduit. As the compressed air flowed through the device, the Solutions A and B were drawn up the respective collection tubes, through the Y connector, and into the spray device where they were mixed and ejected through the nozzle. This mixed composition (Solution D) was collected in a 2,000 ml beaker for analysis.

The absorbance of each solution in the range of 400 nm to 700 nm was measured using a Perkin Elmer UV/vis spectrophotometer. Solution A, which contained only water, had an absorbance at 523 nm equal to 0.007019. Solution B, which contained water and food coloring, had an absorbance of 0.77827 at 523 nm. Solution C, which contained a 1:1 mixture of Solution A and Solution B, had an absorbance of 0.445109 at 523 nm. Solution D, which was produced by spraying Solution A and Solution B through the device in FIG. 1, had an absorbance of 0.435009 at 523 nm. It can, therefore, be deduced that the concentration of food coloring in Solution D is 97.73% of the concentration of food coloring in Solution C based upon the respective absorbance data. Therefore, the mix ratio of Solutions A and B through the gun was very nearly 1:1. Table 1 below lists the component compositions of Solutions A-D based upon the above procedure in units of weight percent based on the total weight of the particular solution.

TABLE 1

| | Solution A | Solution B | Solution C | Solution D |
|---|---|---|---|---|
| Water | 100 | 99.9875 | 99.99375 | 99.99375 |
| Red Food Coloring | 0 | 0.0125 | 0.00625 | 0.00625 |

Figure 3:
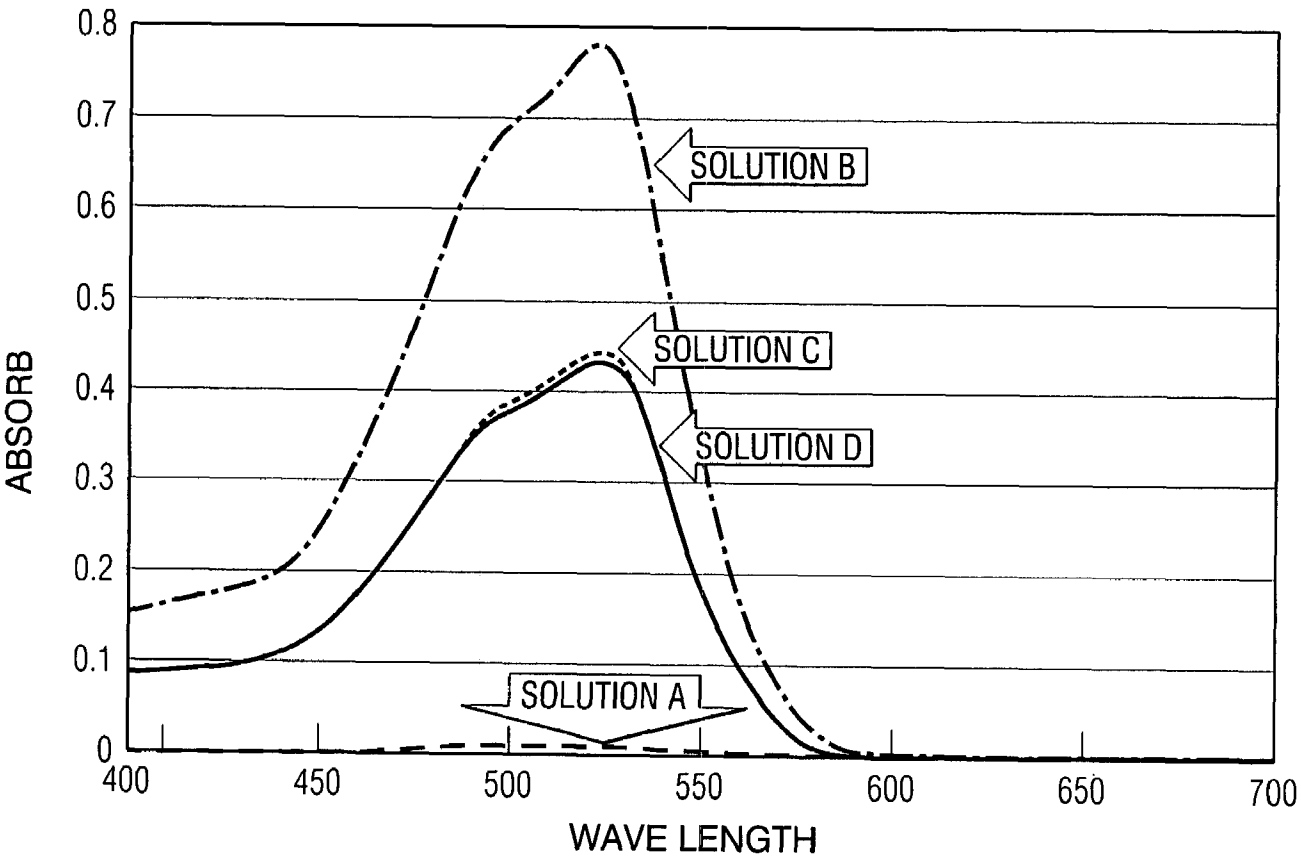
FIG. 3 is a graph of absorption versus wavelength for solutions A-D of Example 1.

A graph of absorption versus wavelength for Solutions A-D is shown in FIG. 3. Comparing Solution C to Solution D, the invention was successful in drawing and mixing substantially equal portions of the pure water and dyed water through the spray gun as evidenced by the respective absorption curves in FIG. 3.

EXAMPLE 2

A commercially available two-component automotive refinish clearcoat (designated DC1100/DC1275 and commercially available from PPG Industries, Inc., of Pittsburgh, Pa.) was utilized to illustrate the ability of the invention to mix the two components of a commercially available coating formulation and to apply the mixed components as a homogeneous coating.

The DC1100 component was reduced to a viscosity of 12.5 centipoises as determined by a Brookfield LBT viscometer (No. 2 spindle, 60 rpm) by the addition of a solvent blend (DT885 commercially available from PPG Industries, Inc.) and was designated Solution E. The second component of the formulation (DC1275) was reduced to a viscosity of 12.5 centipoises by the addition of DT885 and designated Solution F. These individual components (Solution E and Solution F, respectively) were then connected to the spray device as described above and spray applied onto clear glass substrates. A control coating (Solution G) was pre-mixed, diluted, and sprayed applied onto clear glass substrates by conventional spray equipment. The compositions of Solutions E-G are listed in Table 2 below in units of milliliters. Dry film thickness for the two films was measured to be 1.1 mils for both clearcoats as determined by a Fischerscope MMS film thickness gauge available from Fischer Corp.

TABLE 2

| Component | Solution E | Solution F | Solution G |
|---|---|---|---|
| DC1100 | 100 | 0 | 100 |
| DC1275 | 0 | 100 | 100 |
| DT885 | 100 | 100 | 200 |
| Total | 200 | 200 | 400 |

The physical properties of the two cured films (i.e., the coating applied by mixing Solutions E and F in accordance with the practice of the invention as described above and the coating applied in conventional manner from Solution G) were then tested for gloss, hardness, humidity resistance, and adhesion. The results are shown in Table 3 below.

TABLE 3

| Mixing Method | Gloss | Hardness (secs.) | Humidity Resistance | Adhesion |
|---|---|---|---|---|
| Premixed (Solution G) | 88 | 42 | 75 | 100% |
| Mixed during application | 88 | 40 | 76 | 100% |

The gloss was determined using a BYK-Gardner micro-tri gloss meter set for measurement at a 20° angle, in accordance with the manufacturer's instructions. The values listed in Table 3 represent the average gloss value for a minimum of three gloss measurements on each coated substrate examined. Hardness was determined using a commercially available Konig pendulum hardness tester and placing the test panel on a table of the stand, lowering the fulcrum onto the test panel and then deflecting the pendulum to 6°. Hardness was recorded as the time in seconds that the pendulum continued to swing 30 from the center after it had been released. Humidity resistance was determined by exposing the coated glass coupons to 95% to 100% relative humidity in a 40° C. (100° F.) chamber for a period of 10 days and then measuring the gloss using a BYK-Gardner micro-tri gloss meter (20° angle). Adhesion was determined by scribing a pattern of 100, two-millimeter wide squares into the panels using a Super Cutter Guide (commercially available from Taiyu Kizai Company LTD.). Scotch brand #898 was applied over the scribed area and the tape pulled off within 90 seconds of application. The scribed area was then inspected for the percent of coating remaining and the result recorded as the percentage adhesion of the coating, e.g., no failure is equivalent to 100 percent adhesion. The results of the above tests (gloss, hardness, humidity resistance, and adhesion) indicate that the physical properties and performance of the tested coatings are substantially the same whether applied through conventional means or through the coating system of the invention.

EXAMPLE 3

This example illustrates the operation of a coating system as shown in FIG. 2 of the drawings. In this example, all viscosity measurements were determined using a Brookfield LVT cone and plate viscometer at a shear rate of 24 seconds$^{-1}$.

The following two components were utilized in this example:

Component 1: was a blend of polyols in an organic solvent (containing methylethylketone, naptha, toluene, and acetate). Component 1 had a resin solids percentage of 66.80 wt. % based on the total weight of the solution.

Component 2: was an isocyanate material dissolved in an organic solvent similar to that used above in Component 1.

The two components were placed in separate containers and both containers were placed within the same pressure vessel to maintain a constant pressure for both components. The pressure in the pressure vessel was maintained at 8 psig (0.6 kg/sq. cm) using compressed air. Rather than being connected to the coating device 12, the first and second collection tubes 40, 45 were directed to two separate graduated cylinders. The flow of the first and second coating components due to the pressure inside the pressure vessel was maintained for a period of 60 seconds, after which the volume of each component was measured.

This procedure was repeated a number of times using the same Component 1 but varying the percent resin solids and, hence, the viscosity of the second coating component. These higher viscosity second components are identified as Components 3 through 5 in Table 4 below.

TABLE 4

| Test No. | Components | Viscosity (Centipoise) | Weight Solids | Volume (ml) | Viscosity Difference | Volume Ratio |
|---|---|---|---|---|---|---|
| 1 | Component 1 | 49.2 cps | 66.80% | 142 | 0 cps | 1.0:1.0 |
| | Component 2 | 49.2 cps | 59.50% | 142 | | |
| 2 | Component 1 | 49.2 cps | 66.80% | 142 | 5 cps | 1.2:1.0 |
| | Component 3 | 54.2 cps | 61.50% | 118 | | |
| 3 | Component 1 | 49.2 cps | 66.80% | 142 | 20 cps | 1.4:1.0 |
| | Component 4 | 69.2 cps | 63.50% | 101.4 | | |
| 4 | Component 1 | 49.2 cps | 66.80% | 142 | 30 cps | 1.6:1.0 |
| | Component 5 | 79.2 cps | 65.50% | 88.8 | | |

As can be seen from Table 4, the difference in viscosity of the two components results in a difference in the flow rate through the collection tubes and a corresponding difference in the volume ratio of the two components delivered. This example illustrates that the volume of each component is dependent upon the viscosity of the individual components under constant and equal pressure. In this way, the mix ratio of a multi-component coating formulation can be controlled by selecting or adjusting the various coating components to provide a mixed coating of a desired composition.

It will be readily appreciated by those skilled in the art that modifications may be made to the invention without departing from the concepts disclosed in the foregoing description. Accordingly, the particular embodiments described in detail herein are illustrative only and are not limiting to the scope of the invention, which is to be given the full breadth of the appended claims and any and all equivalents thereof.

EXAMPLE 4

The following example illustrates that the rheological profile of at least one of the first coating component and the at least one other coating component can be selected by including in such components two or more materials comprising different functional groups. Table 5 below lists the compositions of a two component coating system. Each of the listed materials was combined and blended to form the coating component.

TABLE 5

| Material | Weight (grams) | Solids (grams) |
|---|---|---|
| Component 1 | | |
| Methyl Isobutyl Ketone | 34.30 | — |
| Pentyl Propionate | 52.03 | — |
| Methyl Isoamyl Ketone | 55.38 | — |
| UV Absorber[1] | 4.34 | 4.34 |
| UV Absorber[2] | 3.83 | 3.83 |
| Silicone Additive[3] | 1.62 | 0.81 |
| Dibutyl Tin Dilaurate | 2.86 | 2.86 |
| Propoxylated TMP[4] | 23.18 | 23.18 |
| Acrylic Polyol[5] | 101.46 | 57.33 |
| Acrylic Polyol[6] | 108.79 | 69.63 |
| Component 2 | | |
| Methyl Isobutyl Ketone | 26.62 | — |

TABLE 5-continued

| Material | Weight (grams) | Solids (grams) |
|---|---|---|
| Pentyl Propionate | 40.38 | — |
| Methyl Isoamyl Ketone | 42.97 | — |
| Silicone Additive[3] | 1.63 | 0.82 |
| Isocyanate Oligomer[7] | 57.88 | 57.88 |
| Isocyanate Oligomer[8] | 164.40 | 115.08 |
| Acrylic Silane Resin[9] | 0.83 | 39.38 |
| Tetraethyl Ortho Formate | 1.97 | — |

[1]Chisorb 328 available from Chitec Chemical Co.
[2]Sanol LS-292 available from Sankyo Co.
[3]Byk 300 available from Byk Chemie
[4]Polyol TS, propoxylated trimethylol propane, available from Perstorp Inc.
[5]A copoloymer of isostearic acid, hydroxypropyl acrylate, methyl methacrylate, styrene, and glycidal methacrylate (22.4%/23.3%/10.7%/32.4%/11.2% by weight) at 58.8% solids in xylene.
[6]A copolymer of acrylic acid, Cardura E monomer, butyl methacrylate, and hydroxypropyl methacrylate (5.0%/20.5%/25.1%/18.1%/29.8% by weight) at 64% solids in xylene.
[7]DesN 3600, hexamethylene diisocyanate trimer, available from Bayer Corp.
[8]DesN 4470, trimer of isophorone diisocyanate, available from Bayer Corp.
[9]A copolymer of styrene, methacryloxy propyl trimethyoxy silane, methyl methacrylate, butyl methacrylate, and lauryl methacrylate (25.7%/10.0%/26.2%/18.8%/19.3% by weight) at 55.65% solids in xylene.

Test Substrate

The test substrate was an ACT cold roll steel panels (4"×12") supplied by ACT Laboratories, Inc. which was electrocoated with a cationic electrodepositable primer commercially available from PPG Industries, Inc. as ED-6060. Component 1 had a viscosity of 22.3 centipoises as determined by a Brookfield LBT viscometer (No. 2 spindle, 60 rpm). Component 2 had a viscosity of 21.8 centipoises. These components were connected to the spray device as described above and spray applied onto the substrate. The coating was cured for 10 minutes at 140° F. Dry film thickness was measured to be 2.05 mils as determined by a Fischerscope MMS film thickness gauge available from Fischer Corp.

The physical properties of the cured film was then tested. The results are shown in Table 6 below.

TABLE 7

| Gloss | Hardness | DOI | Adhesion |
|---|---|---|---|
| 88 | 89 | 80 | 100% |

The gloss, hardness and adhesion were determined as described above for Example 2. Distinctness of image ("DOI") of the panel was determined using a Dorigon II DOI Meter, which is commercially available from Hunter Lab, where a higher value indicates better coating appearance on the test panel.

What is claimed is:

1. A method of applying a multi-component coating composition to a substrate with a spray applicator in which each component is delivered to and mixed in a mixing chamber within the spray applicator to form a coating mixture that is discharged from the spray applicator to form a coating on the substrate wherein one of the components is a polymeric material having functional groups and another component is a crosslinking agent containing functional groups capable of reacting with the functional groups of the polymeric material; the method further comprising selecting and/or adjusting the rheological profile of the polymeric material and/or the crosslinking agent by adding one or more materials having functional groups that are different from and compatible with the functional groups of the component to which the materials are added and are reactive with the functional groups of the other component such that these components are delivered to the spray applicator at a predetermined volume ratio over a varied temperature range and shear rate range.

2. The method of claim 1, comprising changing the rheological profile of at least one of the coating components to deliver a different ratio of the coating components to the coating device compared to the ratio before changing.

3. The method of claim 1, wherein the polymeric component comprises a first material containing hydroxyl groups and a second material containing functional groups selected from epoxy, amine, acetoacetate, cabodiimide, aziridine, acrylate, ketimine, aldimine, aspartic ester, and mixtures thereof.

4. The method of claim 1, wherein the curing agent component comprises a material containing isocyanate groups and a second material containing functional groups selected from epoxy, alkoxy silane, polyanhydride, and mixtures thereof.

* * * * *